US007077691B2

(12) United States Patent
Yokoo et al.

(10) Patent No.: US 7,077,691 B2
(45) Date of Patent: Jul. 18, 2006

(54) CONNECTOR HAVING A WALL PORTION BETWEEN AN INSERTING PORTION AND AN ACTUATOR

(75) Inventors: Hiroyuki Yokoo, Tokyo (JP); Takaaki Kudo, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 11/264,434

(22) Filed: Nov. 1, 2005

(65) Prior Publication Data

US 2006/0094288 A1 May 4, 2006

(30) Foreign Application Priority Data

Nov. 1, 2004 (JP) ..... 2004-317533

(51) Int. Cl.
*H01R 12/24* (2006.01)

(52) U.S. Cl. ..... 439/495; 439/260

(58) Field of Classification Search ..... 439/495
See application file for complete search history.

(56) References Cited

U.S. PATENT DOCUMENTS

| | | | | |
|---|---|---|---|---|
| 4,718,859 | A * | 1/1988 | Gardner | 439/495 |
| 5,639,260 | A * | 6/1997 | McHugh | 439/495 |
| 2005/0118849 | A1 * | 6/2005 | Okita et al. | 439/260 |

FOREIGN PATENT DOCUMENTS

| | | | |
|---|---|---|---|
| JP | 2002-015826 | A | 1/2002 |
| JP | 2002-124331 | A | 4/2002 |

* cited by examiner

*Primary Examiner*—Briggitte R. Hammond
(74) *Attorney, Agent, or Firm*—Frishauf, Holtz, Goodman & Chick, P.C.

(57) ABSTRACT

In a connector including an actuator for driving a conductive contact having a contacting portion and an operating portion which are movable with respect to a housing, the housing holds the contact and is provided with a wall portion disposed between the contacting portion and the operating portion. An inserting portion for insertion of a connection object is formed between the wall portion and the contacting portion. The actuator has a cam engaged with the operating portion and the wall portion and rotatable with respect to the housing.

10 Claims, 5 Drawing Sheets

CONNECTOR HAVING A WALL PORTION BETWEEN AN INSERTING PORTION AND AN ACTUATOR

This application claims priority to prior Japanese application JP 2004-317533, the disclosure of which is incorporated herein by reference.

BACKGROUND OF THE INVENTION

The present invention relates to a connector to be connected to a connection object such as a flexible printed circuit board (FPC).

For example, a connector of the type is disclosed in Japanese Unexamined Patent Application Publication (JP-A) No. 2002-15826 or 2002-124331 and comprises a housing, a conductive contact held by the housing, and an actuator rotatably coupled to the housing to drive the contact. The contact has a contacting portion to be contacted with a connection object and an operating portion faced to the contacting portion. The actuator has a cam disposed between the contacting portion and the operating portion of the contact and engaged with the operating portion. Between the cam of the actuator and the contacting portion of the contact, an inserting portion for insertion of the connection object is formed.

The connection object is inserted into the inserting portion in a state where the actuator is located at an opened position. After the connection object is inserted into the inserting portion, the actuator is rotated to a closed position. Then, the connection object is clamped between the cam and the contacting portion. Further, the operating portion is driven by the cam in a direction away from the contacting portion. As a consequence, the contacting portion is strongly press-contacted with the connection object. Thus, the connection object is connected to the connector. Accordingly, the connection object is easily inserted into the inserting portion and connection is established under strong force.

However, when the actuator is rotated from the opened position to the closed position, the cam is brought into sliding contact with the connection object. Accordingly, following the rotation of the actuator, the connection object may be undesirably displaced from a proper position. For example, the connection object may be moved in an ejecting direction outward from the inserting portion to thereby cause a failure in achieving desired connection.

SUMMARY OF THE INVENTION

It is therefore an object of this invention to provide a connector which is capable of preventing a connection object from being displaced from a proper position when an actuator is operated from an opened position to a closed position.

Other objects of the present invention will become clear as the description proceed.

According to an aspect of the present invention, there is provide a connector comprising a housing, a conductive contact held by the housing, an actuator for driving the contact, and an inserting portion for insertion of a connection object, the contact having a movable portion movable with respect to the housing, the movable portion comprising a contacting portion to be contacted with the connection object, an operating portion faced to the contacting portion, and a coupling portion coupling the operating portion and the contacting portion, the housing having a wall portion disposed between the contacting portion and the operating portion, the actuator comprising a cam engaged with the operating portion and the wall portion and rotatable with respect to the housing, the inserting portion being formed between the wall portion and the contacting portion.

DESCRIPTION OF THE PREFERRED EMBODIMENT

DESCRIPTION OF THE PREFERRED EMBODIMENT

Figure 1:
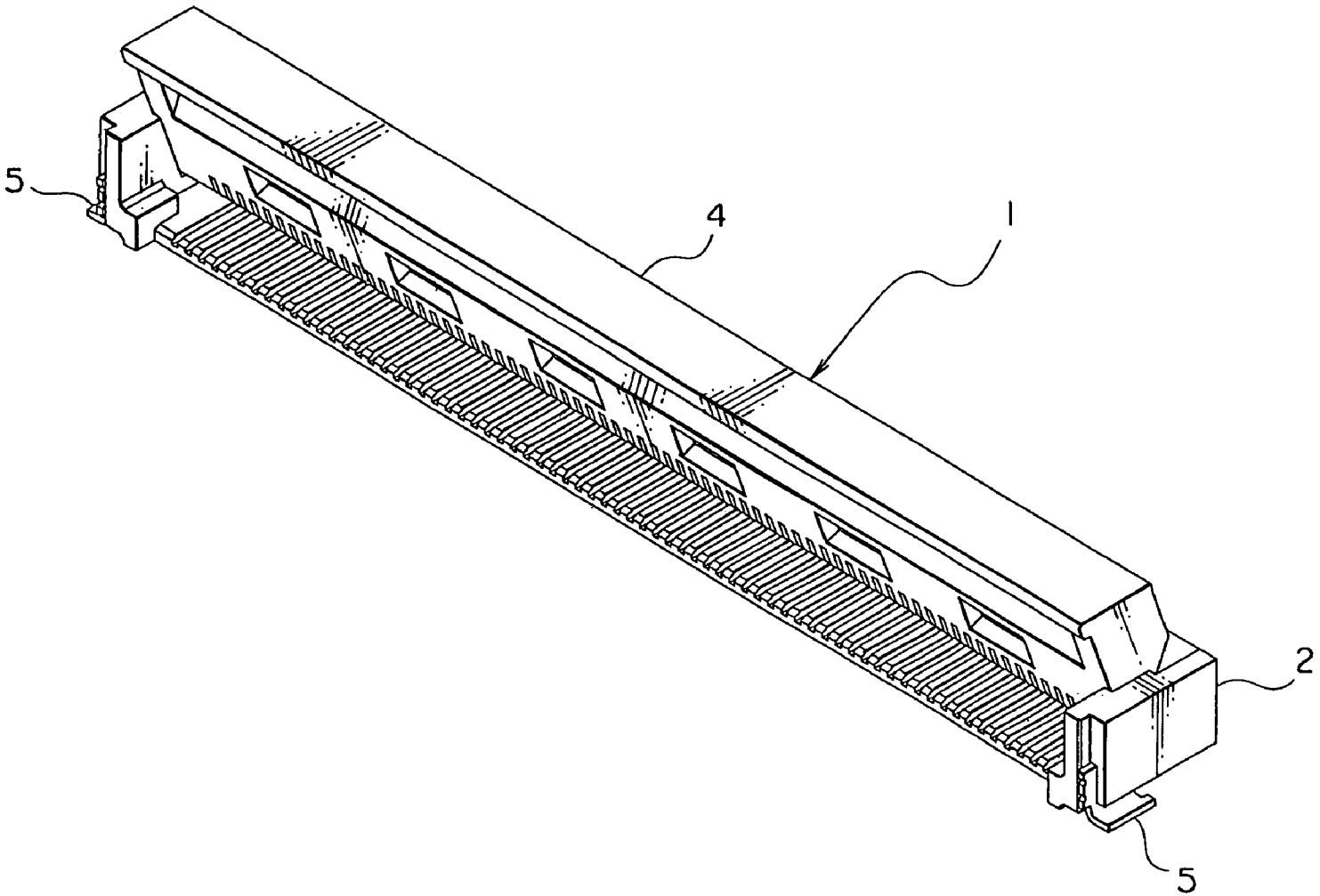
FIG. 1 is a perspective view of a connector according to an embodiment of this invention in a state where an actuator is opened.
Figure 2:
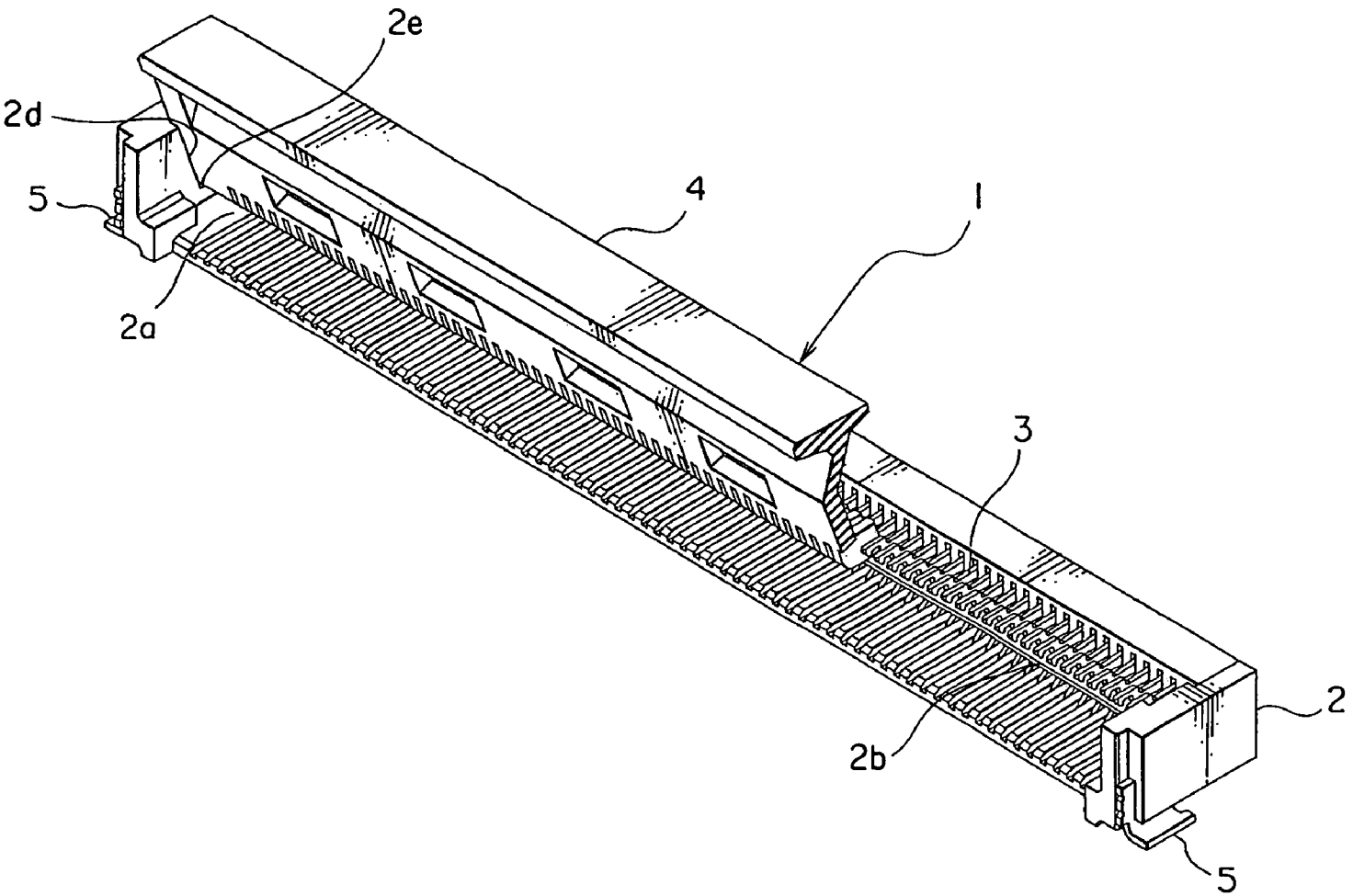
FIG. 2 is a perspective view of the connector illustrated in FIG. 1 in a state where a part of the actuator is cut away.
Figure 3:
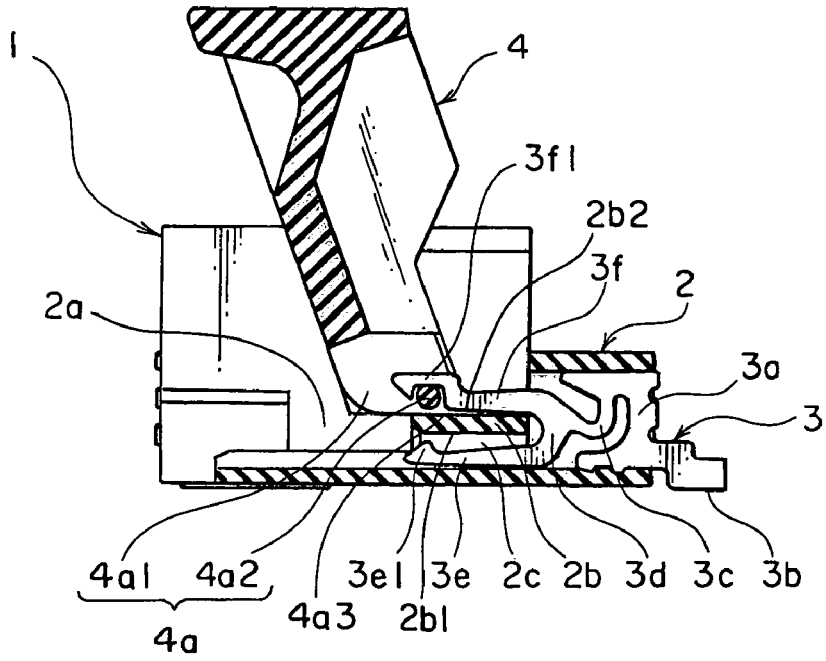
FIG. 3 is a sectional view of the connector illustrated in FIG. 1.

Referring to FIGS. 1 to 3, description will be made of a structure of a connector according to an embodiment of this invention.

The connector depicted by a reference numeral 1 is adapted to connect a flexible printed circuit board (FPC) as a connection object and comprises an insulating housing 2 extending leftward and rightward. The housing 2 holds a number of conductive contacts 3 arranged in a single row at a predetermined pitch. An actuator 4 has an insulating nature and is rotatably coupled to the housing 2 by utilizing the contacts 3 (as will later be described in detail). The housing 2 has hold-downs 5 formed on left and right sides of the housing 2 to fix the housing 2.

Each of the contacts 3 has a fixing portion 3*a* fixed to the housing 2, a terminal portion 3*b* continuous from one end of the fixing portion 3*a*, a connecting portion 3*c* continuous from the other end of the fixing portion 3*a*, a coupling portion 3*d* continuous from the connecting portion 3*c*, a contacting portion 3*e* continuous from one end of the coupling portion 3*d*, and an operating portion 3*f* continuous from the other end of the coupling portion 3*d* and faced to the contacting portion 3*e* with a space kept therefrom. The connecting portion 3*c* is elastically deformable. A combination of the coupling portion 3*d*, the contacting portion 3*e*, and the operating portion 3*f* has a generally U shape and forms a movable portion movable with respect to the housing 2 and elastically deformable.

The housing 2 has an insertion opening 2*a* and a wall portion 2*b* formed inward of the insertion opening 2*a*. The wall portion 2*b* is a plate-like portion extending in leftward and rightward (in FIG. 3, in a direction perpendicular to a drawing sheet) through the space between the contacting portions 3*e* and the operating portions 3*f* of the contacts 3. The wall portion 2*b* has a flat first surface 2*b*1 faced to the contacting portions 3*e* and a flat second surface 2*b*2 faced to the operating portions 3*f*. The first and the second surfaces 2*b*1 and 2*b*2 are parallel to each other.

The contacting portion 3*e* of each contact 3 has a contact point 3*e*1 formed near its end and protruding towards the first surface 2*b*1 of the wall portion 2*b*. On the other hand, the operating portion 3*f* has a U-shaped cutout or recess 3*f*1 which is formed at a position near its end and corresponding to the contact point 3e1 and which is faced to the second surface 2b2 of the wall portion 2b.

The actuator 4 serves to drive the contacts 3 and has a cam 4a which is rotatable with respect to the housing 2. The cam 4a has a plurality of parallel plate portions 4a1 kept in contact with the second surface 2b2 of the wall portion 2b, and a plurality of rotation support portions 4a2 each of which has a circular section and is connected between adjacent ones of the plate portions 4a1. Each of the rotation support portions 4a2 is rotatably fitted to the recess 3f1 of the operating portion 3f of each contact 3. When the actuator 4 is operated, the cam portion 4a is rotated around the rotation support portions 4a2. The plate portions 4a1 has end faces 4a3 which serve as a cam surface brought into sliding contact with the second surface 2b2 of the wall portion 2b. In the above-mentioned manner, the cam 4a is engaged with the wall portion 2b and the operating portions 3f.

The actuator 4 is supported by the wall portion 2b and wall surfaces 2d and 2e of the housing 2 so as to be rotatable around the rotation support portions 4a2 by about 90 degrees. Since the rotation support portions 4a2 of the actuator 4 are engaged with the recesses 3f1 of the contacts 3, respectively, the actuator 4 is prevented from being released from the housing 2. Therefore, no special shaft is required in order to rotatably support the actuator 4.

Further, the housing 2 is provided with an inserting portion 2c formed between the wall portion 2b and the contacting portions 3e of the contacts 3. The inserting portion 2c has one surface, i.e., an upper surface defined by the wall portion 2b and the other surface opposite to the one surface, i.e., a lower surface covered with a part of the housing 2.

Figure 4:
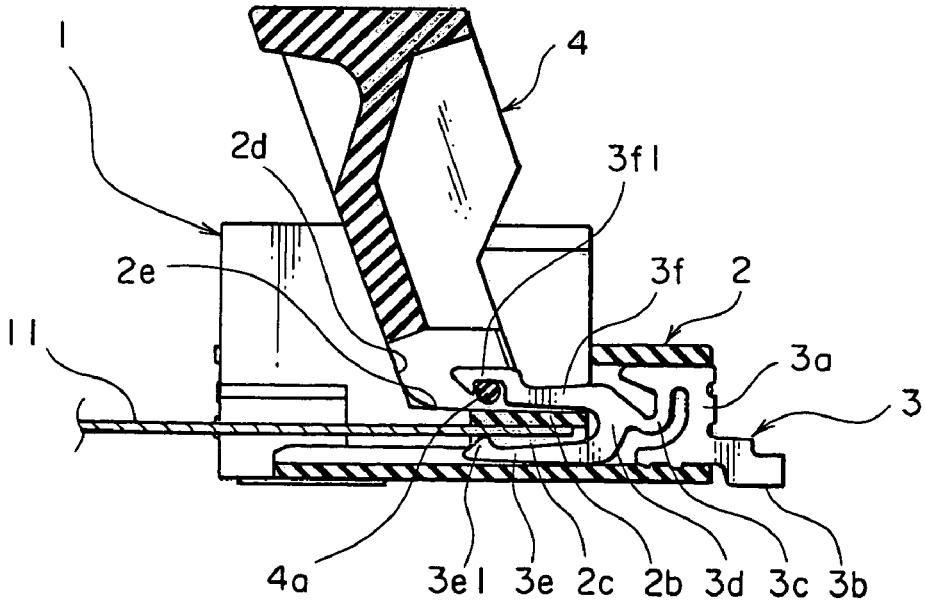
FIG. 4 is a sectional view similar to FIG. 3 in a state where a connection object is inserted into the connector in FIG. 1.

In a state where the actuator 4 is opened as shown in FIGS. 1 to 3, a FPC 11 is inserted through the insertion opening 2a of the housing 2 into the inserting portion 2c as shown in FIG. 4. Since the contact points 3e1 of the contacts 3 are spaced from the first surface 2b1 of the wall portion 2b by a sufficient distance, the FPC 11 can easily be inserted into the inserting portion 2c.

Figure 5:
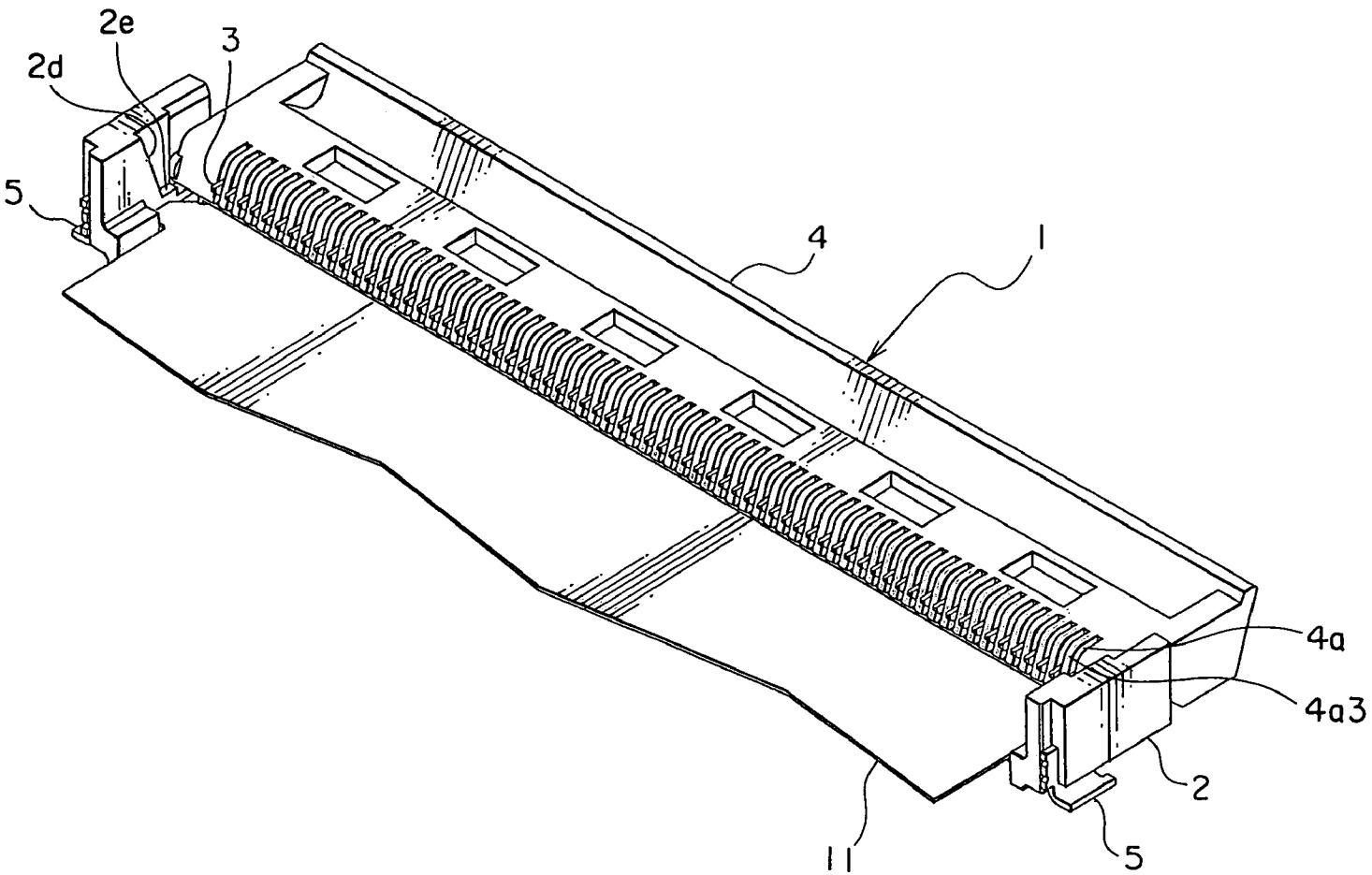
FIG. 5 is a perspective view of the connector illustrated in FIG. 1 in a state where the connection object is connected thereto.
Figure 6:
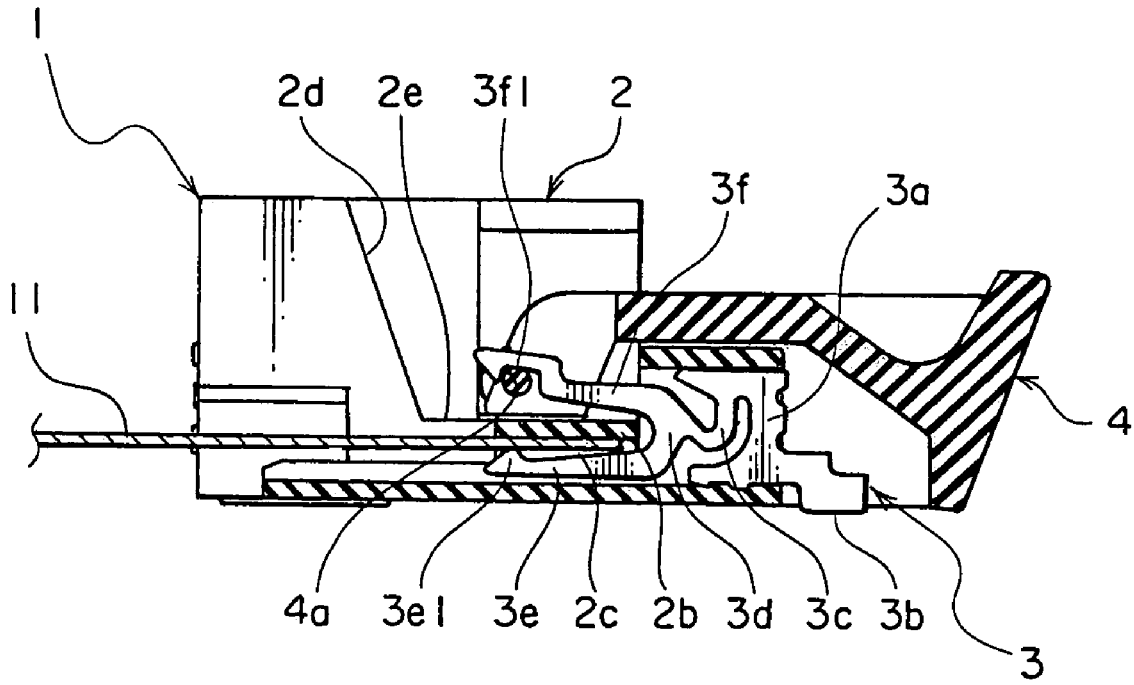
FIG. 6 is a sectional view of the connector in FIG. 5.

After the FPC 11 is inserted into the inserting portion 2c, the actuator 4 is pushed and rotated clockwise in FIG. 4. As a consequence, the actuator 4 is closed as shown in FIGS. 5 and 6. When the actuator 4 is rotated, the cam 4a is brought into sliding contact with the wall portion 2b but is not brought into contact with the FPC 11. Accordingly, the FPC 11 is prevented from being ejected from the housing 2 while the actuator 4 is rotated.

When the actuator 4 is rotated to reach a position illustrated in FIGS. 5 and 6, the rotation support portions 4a2 of the actuator 4 push the operating portions 3f of the contacts 3 upwards. Then, the connecting portions 3c are elastically deformed so that the contact points 3e1 of the contacting portions 3e press the FPC 11 against the wall portion 2b of the housing 2. Thus, the connector 1 is connected to an end portion of the FPC 11. Since the inserting portion 2c is prevented from dust penetration by presence of the wall portion 2b, there is less possibility of occurrence of contact failure between the contact points 3e1 of the contacts 3 and a conductor of the FPC 11. Further, since the FPC 11 is press-contacted with the flat first surface 2b1 of the wall portion 2b, no unnecessary deformation occurs.

The housing 2, the contacts 3, and the actuator 4 are assembled in the following manner. At first, the actuator 4 is coupled to the housing 2. Next, the recesses 3f1 of the contacts 3 are engaged with the cam 4a of the actuator 4.

Although this invention has thus far been described in conjunction with the preferred embodiment thereof, it will readily be possible for those skilled in the art to put this invention into practice in various other manners without departing the scope of the appended claims. Although the coupling portion 3d of each contact 3 is substantially undeformable, it may be formed to be elastically deformable. Preferably, at least one of the coupling portion 3d, the contacting portion 3e, and the operating portion 3f of the contact 3 is elastically deformable.

What is claimed is:

1. A connector comprising:
- a housing;
- a conductive contact held by the housing;
- an actuator for driving the contact; and
- an inserting portion for insertion of a connection object;
- the contact having a movable portion movable with respect to the housing;
- the movable portion comprising:
- a contacting portion to be contacted with the connection object;
- an operating portion faced to the contacting portion; and
- a coupling portion coupling the operating portion and the contacting portion;
- the housing having a wall portion disposed between the contacting portion and the operating portion;
- the actuator comprising a cam engaged with the operating portion and the wall portion and rotatable with respect to the housing;
- the inserting portion being formed between the wall portion and the contacting portion.

2. The connector according to claim 1, wherein at least one of the contacting portion, the operating portion, and the coupling portion is elastically deformable.

3. The connector according to claim 1, wherein the contact further has:
- a fixing portion fixed to the housing; and
- a connecting portion movably connecting the movable portion to the fixing portion.

4. The connector according to claim 3, wherein the connecting portion is elastically deformable.

5. The connector according to claim 1, wherein the wall portion has:
- a first surface faced to the contacting portion; and
- a second surface faced to the operating portion;
- the operating portion having a recess faced to the second surface;
- the cam being engaged with the second surface and the recess.

6. The connector according to claim 5, wherein the cam has:
- a rotation support portion rotatably fitted to the recess; and
- a cam surface to be brought into sliding contact with the second surface following rotation of the rotation support portion.

7. The connector according to claim 5, wherein the rotation support portion has a circular section.

8. The connector according to claim 5, wherein the contacting portion has a contact point formed at a position corresponding to the recess and protruding towards the first surface.

9. The connector according to claim 1, wherein the wall portion has a plate-like shape and defines one surface of the inserting portion.

10. The connector according to claim 9, wherein the wall portion protects the inserting portion in cooperation with a part of the housing.

* * * * *